US005988297A

United States Patent [19]

Zimmerman et al.

[11] Patent Number: 5,988,297

[45] Date of Patent: Nov. 23, 1999

[54] VARIABLE ECCENTRIC VIBRATORY HAMMER

[75] Inventors: Robert J. Zimmerman, Lenexa; Kurt N. Winters, Overland Park, both of Kans.

[73] Assignee: Hydraulic Power Systems, Inc., North Kansas City, Mo.

[21] Appl. No.: 09/047,080

[22] Filed: Mar. 24, 1998

[51] Int. Cl.[6] ..... E02D 07/18

[52] U.S. Cl. ..... 173/49; 173/1; 74/61

[58] Field of Search ..... 173/49, 1; 74/61

[56] References Cited

U.S. PATENT DOCUMENTS

| | | | |
|---|---|---|---|
| 1,657,387 | 1/1928 | Goldschmidt . | |
| 1,672,885 | 6/1928 | Goldschmidt . | |
| 2,039,680 | 5/1936 | Byers . | |
| 2,483,318 | 9/1949 | Lazan | 74/61 |
| 2,632,331 | 3/1953 | Pinazza . | |
| 3,291,224 | 12/1966 | Stutz . | |
| 3,433,311 | 3/1969 | Lebelle . | |
| 3,467,207 | 9/1969 | Pyles et al. . | |
| 3,682,254 | 8/1972 | Hoeffleur . | |
| 3,737,244 | 6/1973 | Wilson | 404/117 |
| 3,866,693 | 2/1975 | Century . | |
| 3,948,329 | 4/1976 | Cummings | 173/49 |
| 4,100,974 | 7/1978 | Pepe | 173/49 |
| 4,108,009 | 8/1978 | Fuchigami | 74/61 |
| 4,111,061 | 9/1978 | Thomas | 74/61 |
| 4,168,774 | 9/1979 | Musschoot | 74/61 |
| 4,370,894 | 2/1983 | Sturesson | 74/61 |
| 4,495,826 | 1/1985 | Musschoot | 74/61 |
| 4,616,716 | 10/1986 | Bouplon . | |
| 4,819,740 | 4/1989 | Warrington . | |
| 4,830,597 | 5/1989 | Steier et al. . | |
| 5,088,565 | 2/1992 | Evarts . | |
| 5,253,542 | 10/1993 | Houze . | |
| 5,257,667 | 11/1993 | Sano et al. . | |
| 5,335,561 | 8/1994 | Harvey | 74/61 |
| 5,355,964 | 10/1994 | White . | |
| 5,818,135 | 10/1998 | Riedl | 173/49 |

*Primary Examiner*—Peter Vo
*Assistant Examiner*—James P Calve
*Attorney, Agent, or Firm*—Shook, Hardy & Bacon LLP

[57] ABSTRACT

A vibratory hammer for use in driving a work piece such as a pile, pipe, caisson or plate into the earth includes a support frame 10 adapted to be suspended from a crane or the like, and a vibrator assembly 12 that is suspended from the frame. The vibrator assembly includes at least one pair of laterally spaced, parallel rotary shafts 40 that are rotatable in opposite directions to one another, and a weight 46 is supported on each shaft. Each weight is shiftable radially relative to the corresponding shaft between a balanced position in which the center of mass of the weight is collinear with the longitudinal axis of the shaft, and an eccentric position in which the center of mass of the weight is offset radially from the longitudinal axis of the shaft. Preferably, a fluid-actuated piston-and-cylinder assembly 54 is supported between each weight and the corresponding shaft for selectively carrying out the shifting movement of the weights. However, other types of shifting mechanisms could also be employed.

4 Claims, 2 Drawing Sheets

10
12
14
16
18
20
22
24
26
28
30
32
34
36
38
40
44
46
48
52
54
56
58
60
66
68
70
5.
6.
7.

VARIABLE ECCENTRIC VIBRATORY HAMMER

CROSS-REFERENCE TO RELATED APPLICATIONS

"Not Applicable"

STATEMENT REGARDING FEDERALLY SPONSORED RESEARCH OR DEVELOPMENT

"Not Applicable"

BACKGROUND OF THE INVENTION

The present invention relates generally to vibratory hammers having at least one pair of laterally spaced, rotating eccentric weights and a drive mechanism for driving rotation of the weights at the same speed in opposite directions to one another. More particularly, the invention relates to a vibratory hammer construction in which the weights can be shifted from their eccentric, vibration-producing positions to balanced, non-eccentric positions during start-up and shut-down to avoid the production of potentially destructive strokes that might otherwise result and to be able to control the magnitude of forces generated by the rotation of the eccentric weights.

A known vibratory hammer construction includes a support frame adapted to be suspended from a crane or the like, a vibrator assembly suspended from the frame for generating vibration used to drive a work piece into the earth, and a clamping assembly for selectively clamping and releasing a work piece. The vibrator assembly includes at least one pair of laterally spaced, parallel shafts that are rotatable in opposite directions to one another, and an eccentric weight supported on each rotary shaft such that the center of mass of the weight is radially offset from the longitudinal axis of the corresponding shaft.

A hydraulic or electric motor is provided for driving rotation of the shafts at a speed of, e.g. 1500 rpm to produce vibration in the hammer for driving the work piece into the earth. At start-up, the motor increases the rotational speed of the shafts from zero rpm to the working speed of the hammer. Likewise, when the hammer is shut down, the speed of the shafts is reduced to a stop. A common problem experienced with known hammers arises during these start-up and shut-down periods. As the hammer vibrates at a frequency equal to its natural frequency, potentially destructive strokes can occur that can cause damage to the hammer, the work piece, and/or possibly to adjacent structures such as buildings and the like. Although operators attempt to bring the hammers up to speed or shut them down as quickly as possible to minimize the amount of damaging vibration that occurs. This practice does not eliminate the risk.

BRIEF SUMMARY OF THE INVENTION

It is an object of the present invention to provide a vibratory hammer apparatus having a construction that permits the operator to substantially eliminate vibration of the hammer during start-up and shut-down, especially when the frequency of vibration passes through the range of the natural frequency of the hammer.

It is another object of the invention to provide a hammer that, without adding significant cost or complexity thereto, permits the degree of eccentricity to be selectively adjusted on-the-fly, permitting control of the vibration forces produced by the hammer during operation.

In accordance with these and other objects evident from the following description of a preferred embodiment of the invention, a vibratory hammer includes a support frame and a vibrator assembly, wherein the vibrator assembly includes a body suspended from the support frame, at least one pair of laterally spaced, parallel rotary shafts supported on the body and being rotatable in opposite directions to one another, and a weight supported on each rotary shaft and being shiftable radially relative to the shaft between a balanced position in which the center of gravity of the weight is collinear with the longitudinal axis of the shaft, and an eccentric position in which the center of gravity of the weight is offset radially from the longitudinal axis of the shaft. In addition, the apparatus includes a shifting means for selectively carrying out the shifting movement of the weights. Preferably, the shifting means takes the form of a fluid-actuated piston-and-cylinder assembly that is supported between each weight and the corresponding shaft for selectively carrying out the shifting movement of the weights. However, other types of shifting means are also envisioned.

By providing a variable eccentric vibratory hammer in accordance with the present invention, numerous advantages are realized. For example, by permitting on-the-fly adjustment in the degree of eccentricity of the weights of the vibrator assembly, it is possible to reduce vibration to zero during start-up and shut-down, when the frequency of the vibration of the apparatus approaches the natural frequency thereof. In addition, when the hammer is operating at speed, the construction permits both the frequency and amplitude of the vibrations to be adjusted to provide optimum performance of the hammer in varying soil conditions and in diverse environments.

BRIEF DESCRIPTION OF THE SEVERAL VIEWS OF THE DRAWING

The preferred embodiment of the present invention is described in detail below with reference to the attached drawing, wherein.

DETAILED DESCRIPTION OF THE INVENTION

Figures 1, 2, 3, 4:
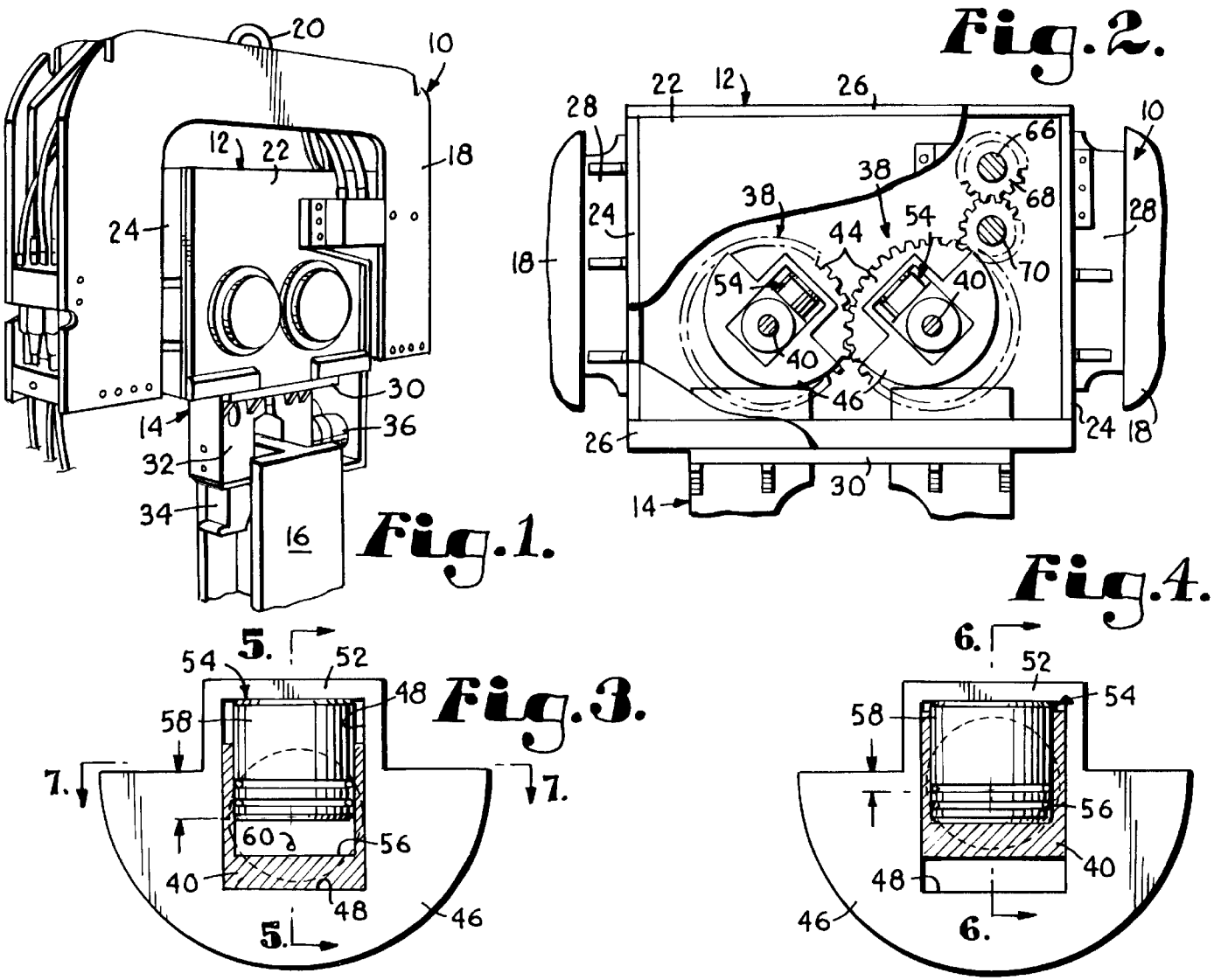
FIG. 1 is a perspective view of a variable eccentric vibratory hammer constructed in accordance with the preferred embodiment.
FIG. 2 is a front elevational view of the hammer, partially cut away to illustrate a pair of shaft assemblies forming a part thereof.
FIG. 3 is a cross-sectional view of one of the shaft assemblies, illustrating a weight forming a part thereof in a balanced, non-eccentric position.
FIG. 4 is a cross-sectional view of one of the shaft assemblies, illustrating the weight in an eccentric position.

A variable eccentric vibratory hammer constructed in accordance with the preferred embodiment of the present invention is illustrated in FIG. 1, and broadly includes a support frame 10, a vibrator assembly 12 suspended from the support frame, and a clamping assembly 14 secured to the bottom of the vibrator assembly for gripping a pile 16 to be driven into the earth.

The support frame 10 includes a pair of plates 18 of inverted U-shaped configuration that are secured together by a plurality of cross members extending between and welded to the plates. A shackle, sling, hook, loop, or the like 20 is attached to the cross members extending between the plates at the top of the frame and enables the apparatus to be supported from a crane or the like during use. Although the vibratory hammer is shown as being supported in the frame 10, it is understood that the hammer could be supported directly by a work piece, and that the use of a support frame is unnecessary in such instances. As such, use of the frame is optional. Likewise, frames of different configurations may also be employed.

The vibrator assembly 12 is of generally square or rectangular shape, and includes opposing front and back plates 22 spaced from one another by laterally spaced side walls 24 and vertically spaced top and bottom walls 26 such that the plates and walls form a body presenting a substantially enclosed interior space. A generally rectangular plate 28 extends from and is welded to each side wall of the body to present a bracket by which the vibrator assembly is suspended by the support frame. Preferably, several gussets are welded between the brackets and the side walls 24 for strength to support the brackets against loads exerted on them during use. The brackets 28 are secured to the support frame through conventional elastomeric dampeners that substantially isolate vibration of the assembly 12 from the support frame 10.

The clamping assembly 14 is bolted to the bottom wall 26 of the vibrator assembly body, and provides a means for selectively clamping and releasing a work piece 16 such that the apparatus can clamp the work piece and drive it into the earth during operation of the vibrator assembly. The illustrated clamping assembly is a sheet clamping assembly which includes an upper base 30 by which it is secured to the body, a depending clamp 32 presenting a pair of laterally spaced jaws that are movable toward and away from one another to grip or release a work piece, and a pair of depending guide elements 34 presenting a tapered opening or mouth to the clamp such that a work piece is guided into the clamp as the apparatus is lowered into place onto the work piece. In addition, the clamping assembly includes a hydraulic piston and cylinder assembly 36 or the like for selectively moving the jaws of the clamp and holding them in place on demand.

Although the apparatus is illustrated as including the sheet clamping assembly 14, it is noted that other types of clamping assemblies are envisioned within the scope of the invention. For example, it is possible to substitute any other mechanism for the clamping assembly which transmits the forces generated by the vibrator assembly to a work piece or other object to be manipulated by the apparatus. Examples of such mechanisms include casson clamp assemblies, square or circular concrete clamp assemblies, pipe clamp assemblies, and round wood clamp assemblies, all of which are conventional assemblies known in the art.

As shown in FIG. 2, the parts of the vibrator assembly 12 responsible for producing vibration forces during operation of the apparatus are supported within the interior space of the body, and broadly include at least one pair of laterally spaced, parallel rotary shaft assemblies 38 supported between the front and back plates 22 of the body and a drive means for driving rotation of the shafts in opposite directions to one another.

Figure 5:
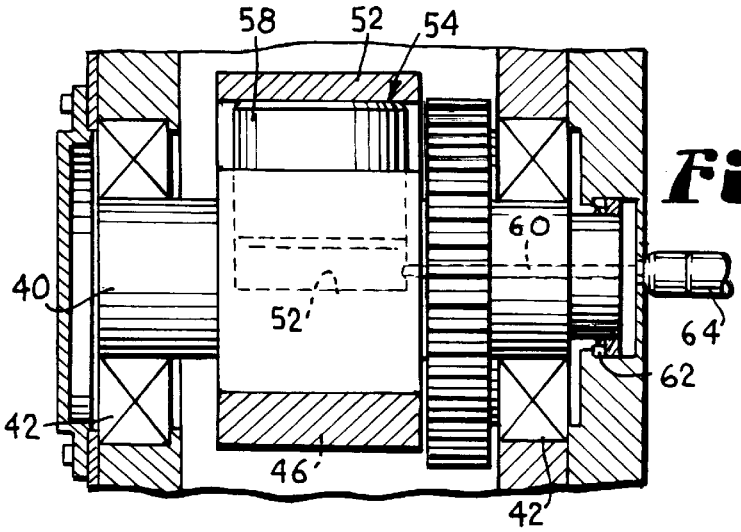
FIG. 5 is a sectional view taken along line 5—5 of FIG. 3 of one of the shaft assemblies, illustrating the weight in a balanced, non-eccentric position.
Figure 7:
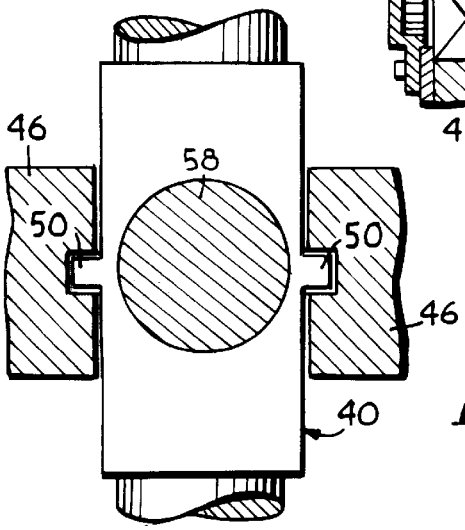
FIG. 7 is a sectional view taken along line 7—7 of FIG. 3, illustrating details of the weight of one of the shaft assemblies.

As shown in FIG. 5, each shaft assembly 38 broadly includes a shaft 40, a pair of bearing assemblies 42 for supporting the shaft on the body for relative rotation, a pinion 44 for transmitting drive to the shaft from the drive means, a weight 46 supported on the shaft for rotation therewith, and a shifting means for selectively carrying out radial shifting movement of the weight relative to the shaft. With reference to FIGS. 3 and 4, the shaft 40 includes a central region 48 having a square or rectangular cross-sectional shape presenting a pair of diametrically opposed guide surfaces that receive the weight on the shaft and guide the weight for relative radial movement between a balanced position in which the center of mass of the weight is collinear with the longitudinal axis of the shaft, and at least one eccentric position in which the center of mass of the weight is offset radially from the longitudinal axis of the shaft. Preferably, as shown in FIG. 7, each guide surface of the shaft includes a tongue or step 50 that mates with a cooperating groove in the weight to prevent the weight from shifting axially relative to the shaft. As such, the weight 46 rotates with the shaft 40 and is fixed axially thereon, while being free to shift radially upon actuation of the shifting means.

Returning to FIG. 5, journals are formed adjacent the ends of the shafts 40, and are sized for receipt in the bearing assemblies 42 such that the shafts are secured to the body for relative rotation thereto. Each shaft also includes a stepped section between one of the journals and the square central region for receiving the pinion 44, and is keyed to the pinion at the stepped section so that drive transmitted to the pinion rotates the shaft.

As shown in FIG. 3, the weight 46 of each assembly 38 is preferably formed of a solid piece of steel or other suitable material, and is preferably semi-cylindrical in shape. Alternately, other suitable shapes can be employed. A square or rectangular cut-out is formed in the weight and a U-shaped wall 52 protrudes from the planer surface of the weight over the cut-out to form an end wall of the cut-out, closing off the cut-out so that it is completely circumscribed by the material of the weight. The cut-out presents a pair of interior side walls that are received on and guided by the guide surfaces of the shaft 40. As mentioned, the side walls preferably include grooves that mate with corresponding tongues 50 formed in the guide surfaces of the shaft, as shown in FIG. 7, to secure the weight against axial movement relative thereto.

The illustrated shifting means for carrying out the selective radial shifting movement of the weight of each shaft assembly is shown in FIG. 5 and includes a fluid-actuated piston-and-cylinder assembly 54 supported between the weight and the shaft, and a fluid circuit for supplying the assembly with working fluid under pressure. The assembly 54 preferably includes a cylinder 56 formed in the square segment of the shaft, and a piston 58 received in the cylinder and bearing against the end wall of the weight. The cylinder 56 is elongated, extending in a direction transverse to the longitudinal axis of the shaft such that when the piston 58 is extended, it moves the weight radially relative to the shaft from the eccentric to the balanced position.

The fluid circuit is preferably a hydraulic circuit including a fluid passageway 60 extending through the shaft 40 between the cylinder 56 and an axial end of the shaft, a hydraulic line 64 formed in or extending through the wall of the frame adjacent the end of the shaft, and a conventional control mechanism for controlling the flow of hydraulic fluid to and from the line. Preferably, the end of the shaft 40 is received in the wall of the frame 10, and a seal 62 is positioned around the end of the shaft between the shaft and the frame wall so that fluid flowing between the hydraulic line and the fluid passageway is prevented from leaking at the point of the rotary coupling. When fluid under pressure is supplied to the cylinder 56, the piston 58 is extended, moving the weight 46 toward the balanced position. When fluid is drained from the cylinder 56, the piston 58 retracts, allowing the weight 46 to move away from the balanced position.

Although the cylinder 56 in each shaft 40 is illustrated in the figures as being a single-acting hydraulic cylinder, it is possible to substitute a double-acting cylinder in place thereof. The use of a double-acting cylinder, along with the requisite hydraulic circuit and control mechanism for controlling the flow of hydraulic fluid to and from both sides of the cylinder, permits positive control of the position of the piston within the cylinder, ensuring that both eccentrics are shifted by equal amounts so that the forces generated within the apparatus are balanced laterally, offsetting one another.

As shown in FIG. 2, the drive means for driving rotation of the shafts preferably includes a hydraulic motor having an output shaft 66 on which a drive gear 68 is supported. One or more transfer gears 70 can be employed for transmitting rotation of the drive gear to the shaft assemblies 38. In order that the shafts are rotated in opposite directions to one another, the transfer gear 70 engages one of the pinions 44 and that pinion, in turn, directly engages the other pinion. However, it is understood that any conventional mechanism can be substituted for the drive shown so long as the shafts 40 are rotated in directions opposite to one another at the rotational speeds required by the apparatus.

During start-up of the apparatus, the pistons 58 of the shifting means are extended, moving the weights 46 to the balanced position shown in FIGS. 3 and 5 so that the centers of mass of the weights are the same as the central longitudinal axes of the shafts 40. In this position of the weights, rotation of the shafts 40 results in the production of no vibration, and the shafts can safely be brought up to working speed without the risk that dangerous vibratory strokes will be produced that might otherwise damage the apparatus, the work piece or surrounding objects such as buildings and the like.

Figure 6:
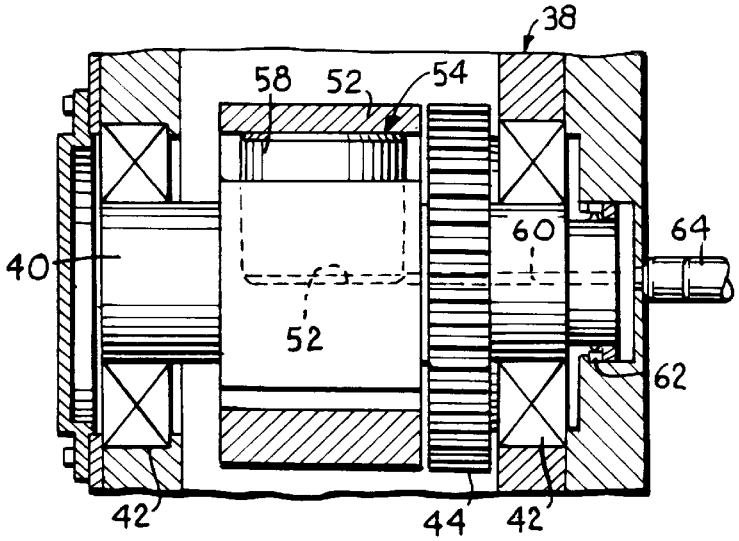
FIG. 6 is a sectional view taken along line 6—6 of FIG. 4 of one of the shaft assemblies, illustrating the weight in an eccentric position.

Once the shafts are brought to a desired speed of rotation, fluid is drained from the cylinders of the assemblies, allowing the piston to retract. Turning to FIGS. 4 and 6, as the weights are shifted radially from the balanced position, the centers of gravity of the weights move radially away from the longitudinal axes of the shafts, throwing the weights radially outward toward the eccentric position. Although the extreme eccentric position is referred to as "the" eccentric position, it is understood that every position of the weights other than the balanced position is actually eccentric. As such, by controlling the position of the piston of the assembly, it is possible to adjust the amount of eccentricity of the weights and thus the amplitude of the vibration produced by the apparatus.

The fluid pressure in the cylinders always works against the centrifugal forces exerted on the pistons by the weights such that it is possible to maintain the weights in any desired eccentric position by controlling the amount of fluid supplied to the cylinders. This feature of the invention allows the operator to adjust the amplitude of the vibration being produced on-the-fly in order to maintain any desired amplitude of vibration. In addition, by adjusting the speed of rotation of the shafts, it is also possible to control the frequency of vibration. Thus, a wide variety of vibratory forces can be produced with a single apparatus, providing greater versatility than conventional vibratory hammers.

Once the work piece has been driven into the earth by the vibratory action of the apparatus and is to be turned off, fluid under pressure is supplied to the cylinders of the assemblies so that the pistons are extended and the weights are shifted against the centrifugal forces exerted thereby to the balanced position shown in FIGS. 3 and 5. Once this shifting of the weights is completed, drive to the shafts is discontinued and they are allowed to slow to a stop, again without running the risk of producing dangerous vibratory strokes that could cause damage to the apparatus or other adjacent objects.

Although the shifting means of the apparatus is illustrated as including a hydraulic piston-and-cylinder system, it is within the scope of the invention to employ other hydraulic systems, or to substitute an electrical or mechanical system in place thereof. Specifically, the piston-and-cylinder assembly could be replaced with any known type of assembly that applies a sufficient radial force on the weights to shift the weights on-the-fly between the balanced and eccentric positions, and that can be selectively controlled by the operator of the apparatus.

For example, solenoids could be supported between the shafts and the weights in much the same manner as the piston-and-cylinder assemblies, and an electrical circuit provided which would permit the operator to actuate the solenoids to shift the weights between the balanced and eccentric positions. Such solenoids could be shiftable between only a pair of extreme positions, or among an infinite number of positions, as desired.

Alternately, the piston-and-cylinder assemblies could be replaced by rack and pinion systems that would be driven by servo or stepper motors to adjust the positions of the weights on the shafts. Likewise, other mechanical, electrical, hydraulic or hybrid systems could be employed to carry out the desired radial shifting movement of the weights on the shafts.

Although the present invention has been described with reference to the preferred embodiment illustrated in the figures of the drawing, it is noted that substitutions may be made and equivalents employed herein without departing from the scope of the invention as recited in the claims.

We claim:

1. A vibratory hammer for use in driving a work piece into the earth, the hammer comprising:

a support frame; and a vibrator assembly including a body suspended from the support frame, at least one pair of laterally spaced, parallel rotary shafts supported on the body and being rotatable in opposite directions to one another, each rotary shaft defining a central longitudinal axis and including a central region presenting a pair of guide surfaces, each including a tongue, and a transverse cylinder extending in a direction parallel to the guide surfaces, a weight supported on each rotary shaft and defining a center of mass, each weight being received on the guide surfaces and including grooves engaging the tongues of the guide surfaces for movement between a balanced position in which the center of mass of the weight is collinear with the longitudinal axis of the shaft, and an eccentric position in which the center of mass of the weight is offset radially from the longitudinal axis of the shaft, and a shifting means for selectively carrying out the shifting movement of the weights, the shifting means including a piston supported in the cylinder of each rotary shaft for radial shifting movement between a retracted position and an extended position.

2. A vibratory hammer as recited in claim 1, wherein each rotary shaft includes a pair of journals by which the shaft is supported on the body, an end section protruding beyond one of the journals, and at least one fluid passageway extending between the end section and the piston-and-cylinder assembly supported by the shaft, and the shifting means includes a rotary fluid coupling received on the end section of each shaft for providing fluid communication to the piston-and-cylinder assemblies.

3. A vibratory hammer as recited in claim 1, wherein each piston-and-cylinder assembly includes a piston that is extended to move the weight to the balanced position and retracted to move the weight to the eccentric position.

4. A vibrator assembly for use in driving a work piece into the earth, the assembly comprising a body;

at least one pair of laterally spaced, parallel rotary shafts supported on the body and being rotatable in opposite directions to one another, each rotary shaft defining a central longitudinal axis and including a central region presenting a pair of guide surfaces, each including a tongue, and a transverse cylinder extending in a direction parallel to the guide surfaces;

a weight supported on each rotary shaft and defining a center of mass, each weight being received on the guide surfaces and including grooves engaging the tongues of the guide surfaces for movement between a balanced position in which the center of mass of the weight is collinear with the longitudinal axis of the shaft, and an eccentric position in which the center of mass of the weight is offset radially from the longitudinal axis of the shaft; and a shifting means for selectively carrying out the shifting movement of the weights, the shifting means including a piston supported in the cylinder of each rotary shaft for radial shifting movement between a retracted position and an extended position.

* * * * *